US008077045B2

(12) United States Patent
Siegel

(10) Patent No.: US 8,077,045 B2
(45) Date of Patent: Dec. 13, 2011

(54) MERCHANDISE SECURING DEVICE HAVING A RECESSED CLOSURE

(75) Inventor: Georg Siegel, Bergkamen (DE)

(73) Assignee: Sentronik GmbH, Kamen (DE)

( * ) Notice: Subject to any disclaimer, the term of this patent is extended or adjusted under 35 U.S.C. 154(b) by 350 days.

(21) Appl. No.: 12/225,784

(22) PCT Filed: Mar. 29, 2007

(86) PCT No.: PCT/DE2007/000577

§ 371 (c)(1),
(2), (4) Date: Nov. 3, 2008

(87) PCT Pub. No.: WO2007/115537

PCT Pub. Date: Oct. 18, 2007

(65) Prior Publication Data

US 2009/0273476 A1 Nov. 5, 2009

(30) Foreign Application Priority Data

Mar. 30, 2006 (DE) ..... 10 2006 015 199

(51) Int. Cl.
*G08B 13/14* (2006.01)

(52) U.S. Cl. ..... 340/572.8; 40/661; 235/492; 235/493; 340/572.9; 340/586

(58) Field of Classification Search .... 340/572.1–572.9, 340/10.1, 584, 586; 235/492, 493; 40/661
See application file for complete search history.

(56) References Cited

U.S. PATENT DOCUMENTS

| | | | | |
|---|---|---|---|---|
| 3,628,267 | A | 12/1971 | Minasy | |
| 6,373,387 | B1 * | 4/2002 | Qiu et al. | 340/572.1 |
| 7,109,867 | B2 * | 9/2006 | Forster | 340/572.3 |
| 7,345,583 | B2 * | 3/2008 | Reid et al. | 340/572.1 |
| 2002/0158762 | A1 * | 10/2002 | Nguyen et al. | 340/572.8 |
| 2003/0020613 | A1 | 1/2003 | Cosnard | |
| 2003/0116632 | A1 | 6/2003 | Zimmerman et al. | |
| 2004/0016269 | A1 | 1/2004 | Skjellerup | |
| 2004/0239506 | A1 | 12/2004 | Cosnard | |

FOREIGN PATENT DOCUMENTS

| | | |
|---|---|---|
| DE | 25 39 035 | 3/1977 |
| DE | 199 63 130 | 6/2001 |
| DE | 10 2005 062 414 | 6/2007 |
| DE | 10 2006 002 225 | 8/2007 |
| FR | 2 701 146 | 8/1994 |
| WO | WO 02/086832 | 10/2002 |
| WO | PCT/EP2006/012386 | 7/2007 |

OTHER PUBLICATIONS

International Search Report.

* cited by examiner

*Primary Examiner* — Thomas Mullen

(74) *Attorney, Agent, or Firm* — Collard & Roe, P.C.

(57) ABSTRACT

The invention relates to a merchandise securing device (1) comprising at least one merchandise securing element (4, 5, 15) and a closing mechanism (6) with a fastening element (8) that can be inserted into a clamping element (18, 19, 20) of the closing mechanism (6) similar to a needle. Such a merchandise securing device (1) is provided with a housing contour that is essentially flat in the attachment area (14) in which the merchandise securing device (1) is fixed to the merchandise. The merchandise securing device (1) comprises a recessed closing mechanism (6) while the at least one merchandise securing element (4, 5, 15) located in or on the merchandise securing device (1) uses acoustomagnetic (AM) technology and/or radio frequency (RF) technology and/or radio frequency identification (RFID) technology.

41 Claims, 4 Drawing Sheets

Fig. 2a
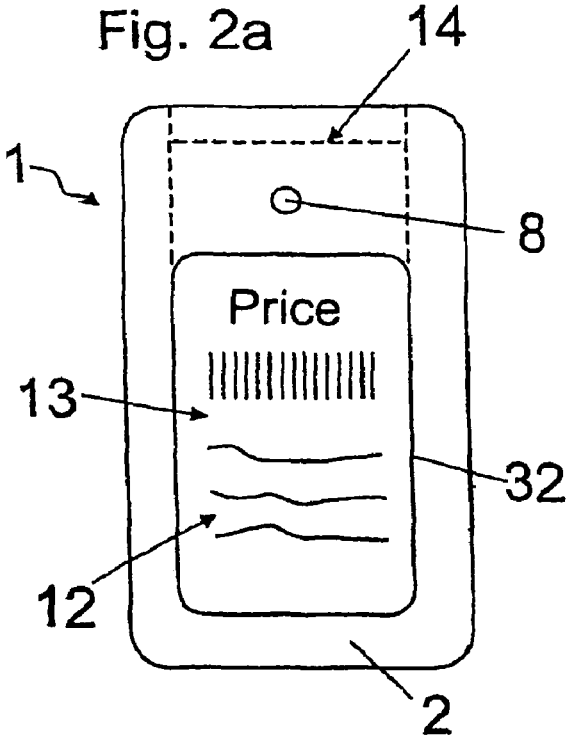
Fig. 2b
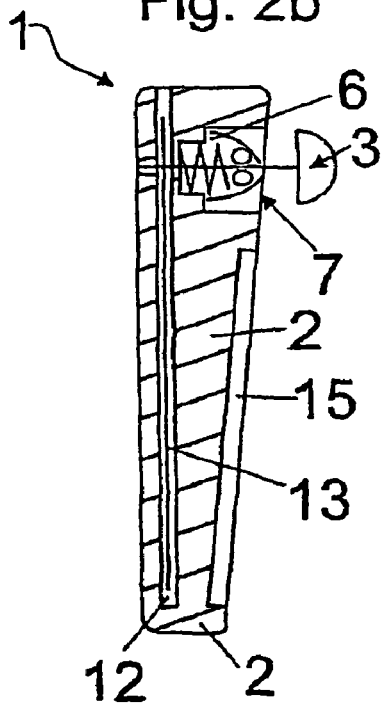
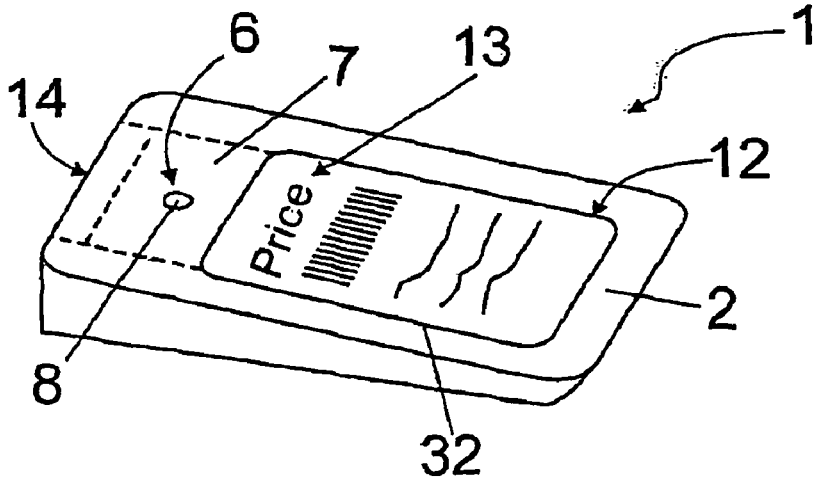
Fig. 2c

Fig. 4
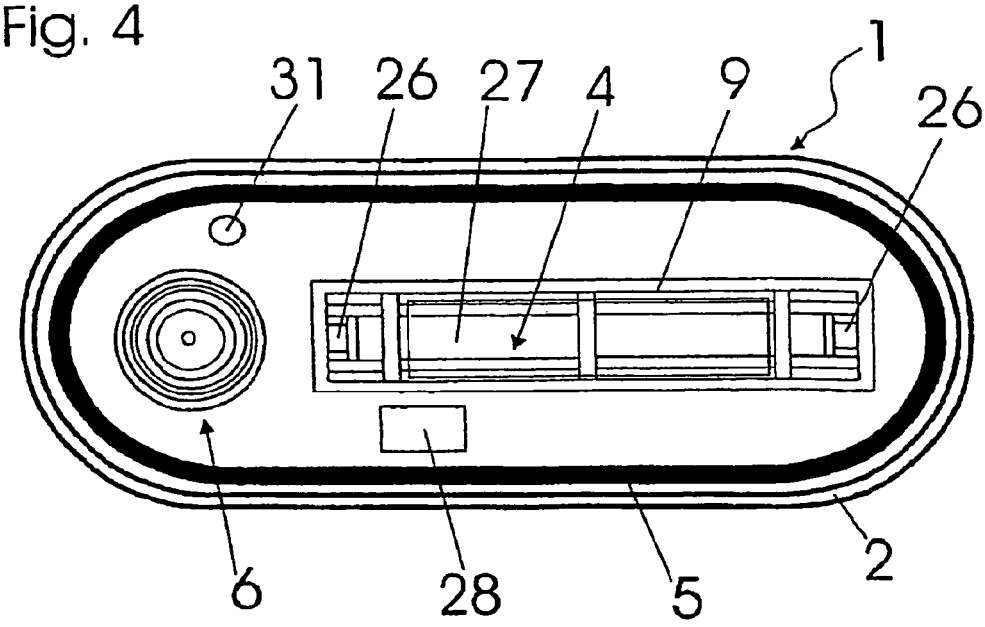
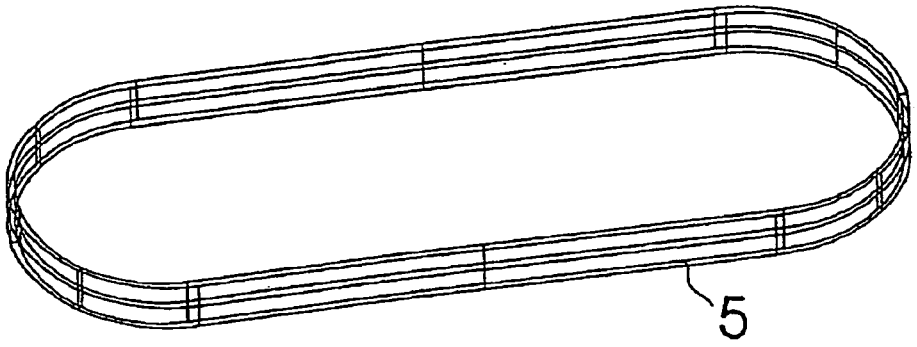
Fig. 5.

MERCHANDISE SECURING DEVICE HAVING A RECESSED CLOSURE

CROSS REFERENCE TO RELATED APPLICATIONS

This application is the National Stage of PCT/DE2007/000577 filed on Mar. 29, 2007, which claims priority under 35 U.S.C. §119 of German Application No. 10 2006 015 199.2 filed on Mar. 30, 2006. The international application under PCT article 21(2) was not published in English.

BACKGROUND OF THE INVENTION

1. Field of the Invention

Nowadays, merchandise securing devices are frequently already attached to the merchandise to be marked during its production, so that these merchandise securing devices remain on the merchandise for a long time, for example even during the entire logistics chain from production to the sales location. For this reason, it is of great importance, because of this long period of attachment of the merchandise securing device to the merchandise, that the merchandise securing devices do not stress the goods mechanically, or not to an impermissible degree, and lead to dents, folds, or other stresses, or even damage to the merchandise.

2. The Prior Art

The merchandise securing devices used nowadays are frequently attached to the merchandise by means of so-called ball closures, in which a needle-like attachment element is inserted into a holder element equipped with clamping elements, for example in the form of balls, and fixed in place with force fit by means of the clamping elements. In this connection, the needle-like attachment element is typically inserted through openings in the merchandise, and is equipped with a wide head for securing the attachment element to the merchandise. Such holder elements are generally configured to be projecting and round, and sit on a housing of the merchandise securing device, on the outside, in such a manner that the holder element is easily accessible for fixation on the merchandise.

It is a disadvantage of this configuration of the merchandise securing devices that in the case of textile goods, in particular, but also in the case of a plurality of other merchandise, great mechanical stress and deformation of the merchandise occurs in the region in which the ball closure lies against the merchandise, because of the arrangement of the ball closure and the housing configuration of the merchandise securing device. Deformation and damage to the merchandise around the projecting ball closure occurs, again and again, as the result of the effect of gravity on hanging merchandise, for example, or pressure stress on merchandise that lies packed; this can lead to the result that the merchandise can only be sold by granting a suitable discount, or cannot be sold at all any more.

Since very different merchandise securing systems using different detection technologies are used in different stores, it is frequently problematic for the manufacturer of the merchandise to be secured to assure merchandise securing devices using the required technology, in each instance, for the related merchandise, during so-called source securing, since a plurality of different merchandise securing devices must therefore be used in parallel, and assigned to the appropriate merchandise, in each instance. This results in high costs and logistical problems in the case of source securing.

It is therefore the task of the present invention to further develop a merchandise securing device of the type stated, in such a manner that in particular, the impairments of or damage to the merchandise as described above can no longer occur, i.e. are reduced to a degree that cannot be avoided, and that the merchandise securing devices can be used as universally as possible.

SUMMARY OF THE INVENTION

The invention proceeds from a merchandise securing device having at least one merchandise securing element and a closure device having an attachment element that can be inserted into a clamping element of the closure device, in needle-like manner. Such a merchandise securing device of the type stated is developed further in that the merchandise securing device has an outer housing shape that is configured in planar manner, essentially in the region where the merchandise securing device is fixed in place on the merchandise, and a closure device disposed in recessed manner, whereby the at least one merchandise securing element uses acousto-magnetic technology (AM technology) and/or radio frequency technology (RF technology) and/or radio frequency identification technology (RFID technology) in or on the merchandise securing device. Because of the configuration of the outer shape of the merchandise securing device, the merchandise lies essentially flat against the merchandise securing device, at least in the region of attachment to the merchandise securing device, and is therefore no longer stressed around the ball closure or the like, which is usually configured to project. The closure device itself can also be structured, with regard to its outer contours, in such a manner that it is configured to be planar in the region of the possible contact zone with the merchandise. It is also possible that the housing of the merchandise securing device covers the closure device essentially over its full area in the region of the possible contact zone with the merchandise, in level manner, and only has one access, for example a small, hole-like access, for insertion of the needle-like attachment element. In addition, manipulation protection of the merchandise securing device is increased by means of such an extensive coverage of the closure device by the housing of the merchandise securing device, since the closure itself is no longer directly open with regard to its method of functioning, and also, the necessary method for releasing the closure device is not easy for a thief to recognize. Furthermore, opening of such closure devices by means of magnetic openers, for example, can be made more difficult with regard to manipulations, in that conventional magnetic openers cannot be used, or can only be used in a specific manner, in order to come into the required effect relationship with the closure device. By placing at least one merchandise securing element that works either with acousto-magnetic technology (AM technology) or radio frequency technology (RF technology) or radio frequency identification technology (RFID technology), or even a plurality of such merchandise securing elements using different technologies, on or in the merchandise securing device at the same time, it is possible to configure a merchandise securing device that can be universally used even for different detection technologies used by the dealers, in each instance, which is equally well suited for and compatible with almost all types of merchandise, whether robust merchandise or light textiles, in which the weight of the merchandise securing device is of great importance for its ability to be used. Such a merchandise securing device can also be changed, if necessary, with regard to the detection technologies used, for example if different merchandise securing elements are fundamentally provided by the design of the merchandise securing device, and can be equipped as the customer wishes, in each instance. When more than one merchandise securing element is used in the merchandise securing device, it is also possible, for example, to dispose multiple detection devices in the detection region, for example at the exit from a store, thereby reducing the possibilities of manipulation of the merchandise securing device and improving the reliability of detection.

Furthermore, it is possible that individual or all of the merchandise securing elements, in each instance, can also be configured so that they cannot be deactivated. In this way, the manipulability of such merchandise securing elements is reduced, since simple detuning of the detection frequencies, for example, is made more difficult by means of preventing manipulations. If a merchandise securing element using RFID technology is used, in particular, the known advantages with regard to the additional inclusion of product-specific data, for example, exist, and can be expanded in that the data in the merchandise securing element using RFID technology can be compared with a barcode on the merchandise at the cash register, and therefore manipulations of the barcode can be discovered, since the data in the merchandise securing element using RFID technology are much more difficult to manipulate than in the case of pure merchandise identification systems such as barcodes.

It is advantageous if the merchandise securing element on the basis of RF technology has a coil arrangement in which multiple windings are disposed perpendicular and parallel to one another, in a so-called multi-layer coil. This has the advantage that excellent functioning of the merchandise securing element can be achieved in the smallest possible space, with an 8.2 MHz center frequency being reached, and a sufficiently great Q factor also being achieved. These requirements are necessary in order to be able to detect with sufficient reliability in the related detection devices such as RF gates and antennas. The necessary tuning of the center frequency with a possibly related merchandise securing element using AM technology and the closure device, which consists of metal, must be taken into consideration in this connection. Since detuning of the center frequency can occur due to these components of the merchandise securing device, compensation must take place by means of adaptation of a capacitor switched in parallel with the coil. In interplay with the other components of the merchandise securing device, the location of the coil in the lower housing section of the merchandise securing device is important, since detuning of the resonance frequency can occur if the coil, which typically consists of copper, is bent outside of its basic shape. For this reason, the coil is correspondingly fixed in place in the lower housing section of the merchandise securing device.

With regard to the configuration of a merchandise securing element on the basis of AM technology, it should be pointed out that for this purpose, merchandise securing elements according to DE 10 2006 002 225.4 A1 can be used, in which an amorphous alloy strip available under the trademark METGLAS can be magnetized with two individual small but strong magnets, in such a manner that very good detection behavior results at the AM frequency. Reference to this older patent is hereby made to its full extent.

It is advantageous if the merchandise securing device has a conventional ball closure or the like as a closure device. Such simple ball closures are sufficiently known from the state of the art, and therefore do not need to be described in greater detail here, with regard to their structure and method of functioning.

It is also possible to design the closure as a disposable closure device that can only be used once and then automatically locks. Such a disposable closure device in the form of a ball closure is also already fundamentally known from DE 10 2005 062 414 A1 or PCT/EP2006/012386. In this connection, a locking device on the ball closure ensures that after activation of the ball closure after the needle-like attachment element is first pulled out, movable parts of the ball closure cannot move back into the non-activated starting position, and the ball closure permanently loses its clamping effect. In this connection, however, it is also possible that such a disposable ball closure, which has lost its function as described, can be unlocked again by means of a special device, not accessible to the public, and thereby can be used again after all.

It is of great importance with regard to manipulation security that the closure device can be configured with a strong-lock function. Such closure devices having a strong-lock function, in which releasing the closure device is typically possible only with magnetic openers having a magnetic field intensity of more than 9000 Gauss, prevent manipulators from manipulating the closure device with magnets they have secretly transported into a store, and releasing it from the merchandise in unauthorized manner. In the production of ball closures with a strong-lock function, particularly strong springs are typically provided in the ball closures.

In another embodiment, the merchandise securing device can be developed further in that the housing of the merchandise securing device has an accommodation, particularly a window-like accommodation, for flat data carriers such as price tags or the like. If such a flat data carrier is inserted into the window-like accommodation disposed, for example, on one of the outer surfaces of the housing of the merchandise securing device, for example an accommodation that is closed off on all sides, with the exception of one edge, and provided with a flat, open or transparent region surrounded by the edging, then the customer can read information concerning the price and possible discounts, for example, concerning merchandise properties, or other information, directly on the merchandise securing device, in clearly legible form, comprehensible to the customer. For the commercial user of such merchandise securing devices, the window-like accommodation offers the possibility of affixing easily replaceable data carriers concerning manufacturing data, barcodes, product identification data, or the like, directly to the merchandise securing device, and thereby using the merchandise securing device as a carrier medium for improving merchandise logistics, for example, even in advance of selling the merchandise.

It is furthermore possible that such data carriers can also be easily removed from the window-like accommodation and handed over to the customer during a payment procedure, for example, for payment at the cash register, or also for returns. In this way, the merchandise securing device simultaneously performs the function that previously had to be performed by additional price tags or labels. Also, the data carriers within the window-like accommodation can easily be replaced and supplemented, or also covered up, something that becomes necessary in the case of a price change, for example.

It is also possible, for example, to dispose merchandise securing elements using AM or RF technology, in addition or alternatively, on a merchandise securing device that accommodates a merchandise securing element using RFID technology within its housing, in such a manner that these merchandise securing elements using AM or RF technology, laminated in, for example, between planar layers of paperboard or plastics, as a thin card, are pushed into the window-like accommodation, and therefore make corresponding merchandise securing technologies available, temporarily or in addition. In this connection, the window-like accommodation serves as an additional accommodation space for merchandise securing elements that are typically configured in thin manner, which are not disposed in the interior of the merchandise securing device itself and therefore can be easily retrofitted by being accommodated in the window-like accommodation. It is advantageous, in this connection, that these merchandise securing elements using AM or RF technology can be hidden in very unnoticeable manner, for example behind a paperboard label containing price information, and that in this way, a further increase in the manipulation security of the merchandise securing device can be achieved, without great additional costs.

It is also possible, for example, that the window-like accommodation as a whole is releasably fixed in place on the housing, and therefore can be separated from the housing. In this way, the window-like accommodation, together with all the data carriers disposed in it, can be released from the merchandise securing device and given to a customer, for example, in its entirety, for making payment for the merchandise at the cash register, without the contents of the window-like accommodation having to be removed from it and possibly getting lost on the way to the cash register.

Another particular property of the merchandise securing device can be achieved in that data carriers laid into the window-like accommodation, or also the additional merchandise securing elements using AM or RF technology, can be secured within the window-like accommodation in that the needle-like attachment element of the merchandise securing device is inserted into the holder device within the housing, relative to the window-like accommodation, in such a manner that unauthorized removal of the data carriers or also of the additional merchandise securing elements using AM or RF technology is blocked by means of the needle-like attachment element. For this purpose, the needle-like attachment element can be disposed on the single open insertion side of the window-like accommodation, for example, in the insertion direction of the data carriers, in such a manner that the needle-like attachment element blocks this open insertion side of the window-like accommodation after the data carrier has been inserted, and the data carrier can no longer be pulled out from there, for example. In another embodiment, it is also possible that the needle-like attachment element passes through a prepared, perforated section of the data carrier itself, for example, when it is inserted into the holder device within the housing, and thereby also secures the data carrier to prevent it from being removed from the window-like accommodation in this way.

In a further embodiment, it is possible that a monitoring device is disposed in the merchandise securing device, and makes contact with alarm devices disposed in the surroundings of the merchandise securing device, by means of a wireless connection, if the merchandise securing device or parts of the merchandise securing device are exposed to heat or an open flame. Specifically in the case of manipulation attempts on conventional merchandise securing devices having conventional ball closures, parts of the housing, which typically consists of plastic, are frequently burned or softened, for example in dressing rooms that are not watched, using lighters or battery-operated soldering guns, in such a manner that functionally important parts of the closure can be removed, in order to subsequently be able to easily remove the merchandise securing device from the merchandise. If a monitoring device, using an electronic temperature detection device, for example, now recognizes that temperatures that can be assessed as a manipulation attempt, for example temperatures above 50° C., prevail in the region of the merchandise securing device, such a monitoring device can transmit a signal to an alarm device, and thereby draw the attention of sales personnel or security personnel to the manipulation attempt that is occurring, and, if applicable, also indicate the location of the manipulation attempt. For this purpose, the monitoring device can have an electronic device for producing a wireless connection with the alarm device, by way of which silent or audible alarms can be triggered at the alarm device.

In another embodiment of the merchandise securing device according to the invention, the device can be made more resistant to manipulations involving heat or an open flame, in that a protector element made of a non-metallic, heat-resistant material is disposed in the region of the closure device, in such a manner that in the case of a manipulation in the region of the closure device, by means of heat or an open flame, the protector element shields the closure device from the heat or the open flame, in improved manner. Such protector elements were previously known only made of metallic materials, for example small metal plates that were introduced into the housing of a merchandise securing device, and guaranteed corresponding shielding of the closure device. Such protector elements made of metallic materials are greatly disadvantageous in the case of the merchandise securing device present here, however, since they, just like the closure device, clearly worsen the method of action of the merchandise securing elements, and, in particular, the resonance frequency of an 8.2 MHz RF coil, and can actually make it impossible. For this reason, non-metallic heat-resistant materials such as mica, silicone, or the like should be introduced, for example, into an accommodation chamber, lying opposite the needle-like attachment means, below the closure element, so that they can form a heat shield and so that it is or becomes more difficult to melt the ball closure out of the housing of the merchandise securing device during manipulation attempts. It is possible, in this connection, that the protector element is formed by a disk-like or shell-like element that is disposed below the closure device. In this connection, the protector element can also be disposed on the housing of the merchandise securing device, or worked into the housing of the merchandise securing device, for example completely integrated into the lower plastic half-shell of the housing, as early as during the injection-molding process of the plastic. In this way, a larger area-covering region can be achieved than with a protector element integrated into the closure device.

It is furthermore possible that a dye ring is disposed on the needle-like attachment element, which surrounds the needle by 3600 in the region of the head of the attachment element. In this way, it can be assured, after the needle-like attachment element has been attached to the closure device, that the needle-like attachment element cannot be manipulated without the risk of dye substance exiting from the dye ring, due to destruction of the dye ring. This additionally increases the security against manipulations of the merchandise securing device.

In another embodiment, it is advantageous if the housing is configured to be mechanically stable, to accommodate the at least one merchandise securing element. If, for example, a merchandise securing element using RFID technology is introduced into the merchandise securing device, the accommodation of such a merchandise securing element in a stable housing has the advantage that the merchandise securing element is very well protected against mechanical stresses. Since merchandise securing elements using RFID technology are quite susceptible to mechanical stresses caused by bending, flexing, or the like, a guarantee of functioning of the merchandise securing element using RFID technology can be achieved by means of accommodation in the stable housing that is able to withstand mechanical stress, even over multiple usage cycles, and thus a high level of reusability can be achieved, thereby clearly increasing the economic efficiency of the merchandise securing device. For example, three to five minimum usage cycles per year can be achieved in this way, at a minimum period of use of five years, without defects of the merchandise securing element, for example due to contact problems or problems in readability, which can otherwise occur during transport.

For this purpose, it is advantageous, in a further embodiment, if the housing is formed from a plastic material, preferably from the plastic ABS, since such a material is very stable mechanically, for one thing, and for another, it also allows corresponding resistance to mechanical manipulation attempts. Also, such a material is not sensitive to thermal stresses that can occur when merchandise securing devices according to the invention are affixed to articles of clothing, for example, which stresses act on the clothing, and therefore also on the merchandise securing device attached to the clothing, by means of thermally acting tunnel finishers for subsequent treatment of articles of clothing after production. The dwell time in the tunnel finisher typically amounts to between 10 and 30 seconds, at a temperature of greater than 150° C. The passage of articles of clothing through steam treatment devices, which can bring about not only a corresponding temperature but also a high level of moisture on the merchandise securing device, also brings about corresponding stresses for the merchandise securing device. Appropriate materials for this purpose, such as ABS, are also advantageous for this, since they are not sensitive to moisture.

Furthermore, it is possible that the housing of the merchandise securing device is sealed to prevent the penetration of moisture, preferably the housing halves that form the sheath of the merchandise securing device are welded to one another. In this way, the penetration of moisture in the steam treatment devices mentioned above, for example, but also from other moisture sources, into the interior of the merchandise securing device is precluded, and thus the function of the components disposed in the housing of the merchandise securing device is guaranteed, even under great moisture stress. In this connection, in a further embodiment, the region of the closure device and the region or the regions of the merchandise securing elements can be configured separate from one another, and be sealed, relative to one another, in fluid-tight manner, in each instance. As a result, moisture that has penetrated into the insertion channel of the closure device, which can never be avoided entirely, is kept away from the other components disposed in the housing of the merchandise securing device, and therefore cannot disrupt their function.

With regard to haptics, but also with regard to cleanliness of the surface of the merchandise securing device, in a further embodiment the housing of the merchandise securing device can have a surface structure that is not smooth, preferably an eroded surface structure. In this connection, uneven areas are worked (eroded) into the mold die for the production of the housing of the merchandise securing device, in targeted manner, and are then reflected in the material of the housing, which is injected into the mold die while it is hot, on the outside of the housing.

It is also advantageous with regard to quality assurance of the merchandise securing device according to the invention if an identification possibility for the point in time of production of the merchandise securing device, preferably a date clock, is visibly applied to the housing. In this way, each merchandise securing device can be precisely identified with regard to its production date, and any problems in production of the merchandise securing device can be traced back, or also, the age of the merchandise securing device can be clearly determined.

In an advantageous modification of the merchandise securing device according to the invention, it is possible that the housing has a through bore, through which flexible hanging devices, particularly wire cables or the like, can be passed with one end, to affix the merchandise securing device, and fixed in place, and which can be fixed in place on the merchandise securing device by means of the closure device at their other end. In this way, the merchandise securing device according to the invention can be modified for being affixed to so-called handle merchandise such as suitcases or the like, on which the merchandise securing device cannot be fixed in place using a needle-like attachment element. Thin steel cables used for this purpose can be fixed in place with a thickened end, for example, which does not fit through the bore in the housing, on the housing of the merchandise securing device, and fixed in place on the closure device with their other end, and thereby loop around a section of the merchandise to be secured, in loose but unreleasable manner.

It is particularly advantageous that the merchandise securing device can be configured to have a small volume and, in total, to be lightweight, for example the weight can be less than 15 g. In this way, the merchandise securing device does not put stress on thin textiles, for example, with its weight, and also cannot deform or damage them impermissibly. Thus, even when the merchandise securing device is disposed to hang on the merchandise, no impermissible stress for such thin textile-like merchandise can occur.

It is furthermore possible that the needle of the attachment element is entirely made from a non-rusting material, preferably from stainless steel. Such materials cannot be damaged at the surface by being inserted into the closure element multiple times, as is the case with needles of basic materials that tend to rust and are only superficially coated with a non-rusting layer, which are very common nowadays, in such a manner that the basic material of the needle, which is then exposed, starts to rust. As a result, particularly if moisture is added, merchandise provided with the merchandise securing device can become dirty, and therefore become unusable or unsellable.

It is furthermore advantageous if the head of the attachment element completely sheathes the needle in its end region that faces away from the closure device, and accommodates the needle within it, and furthermore if the underside of the head of the attachment element, which faces the closure device, is configured to be smooth. Many attachment elements that are commonly used do not have a solid material cross-section on the underside, but rather a honeycomb-shaped hollow cavity construction, in which textile residues or dirt can easily accumulate, and subsequently dirty merchandise provided with the merchandise securing device.

It is important with regard to use of the merchandise securing device that the needle-like attachment element when inserted into the housing of the merchandise securing device, is positioned in such a manner that the thorn-like end does not come to rest where it is freely accessible, for example comes to lie behind a wall of the housing, in covered manner, and therefore the customer cannot be injured by the thorn-like end of the attachment element that unintentionally exits from the closure, on the end side.

BRIEF DESCRIPTION OF THE DRAWINGS

A particularly preferred embodiment of the merchandise securing device according to the invention is shown in the drawing.

This shows.

DETAILED DESCRIPTION OF THE PREFERRED EMBODIMENTS

Figure 1A:
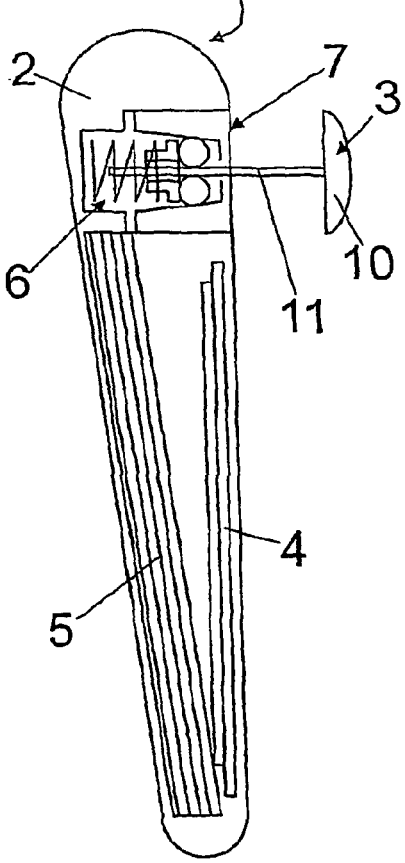
FIG. 1*a*-1*c*—a schematic representation of a first embodiment of the merchandise securing device according to the invention, having a ball closure disposed in covered manner, within a planar contact surface, for merchandise and AM as well as RF securing element, FIG. 2*a*-2*c*—another embodiment of the merchandise securing device according to the invention according to FIG. 1, having a window-like accommodation for data carriers or the like, FIG. 3—an exploded representation of the merchandise securing device according to the invention according to FIG. 1, FIG. 4—a top view of the lower half of the merchandise securing device according to the invention according to FIG. 1, FIG. 5—a spatial view of a coil of the RF securing element of the merchandise securing device according to the invention.
Figure 1B:
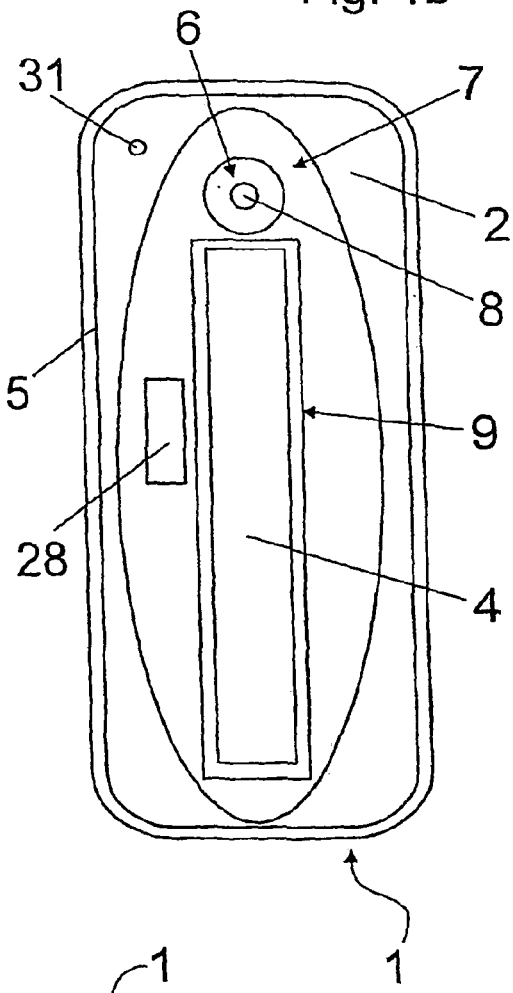
Figure 1C:
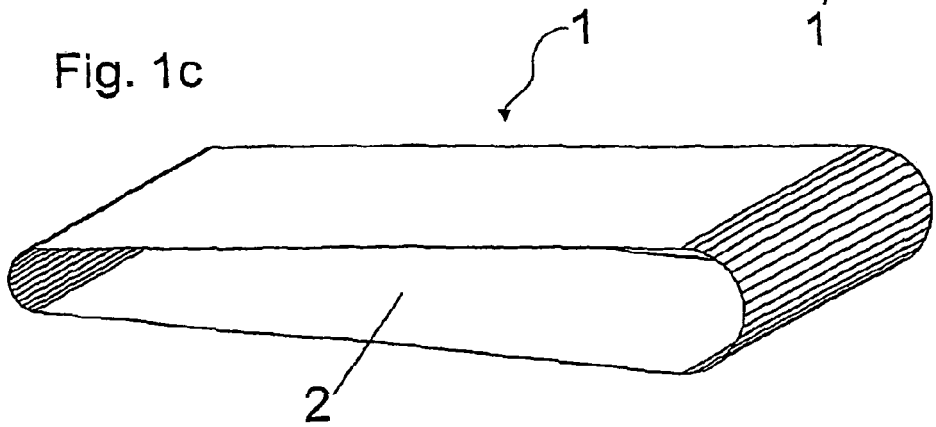
Figure 3:
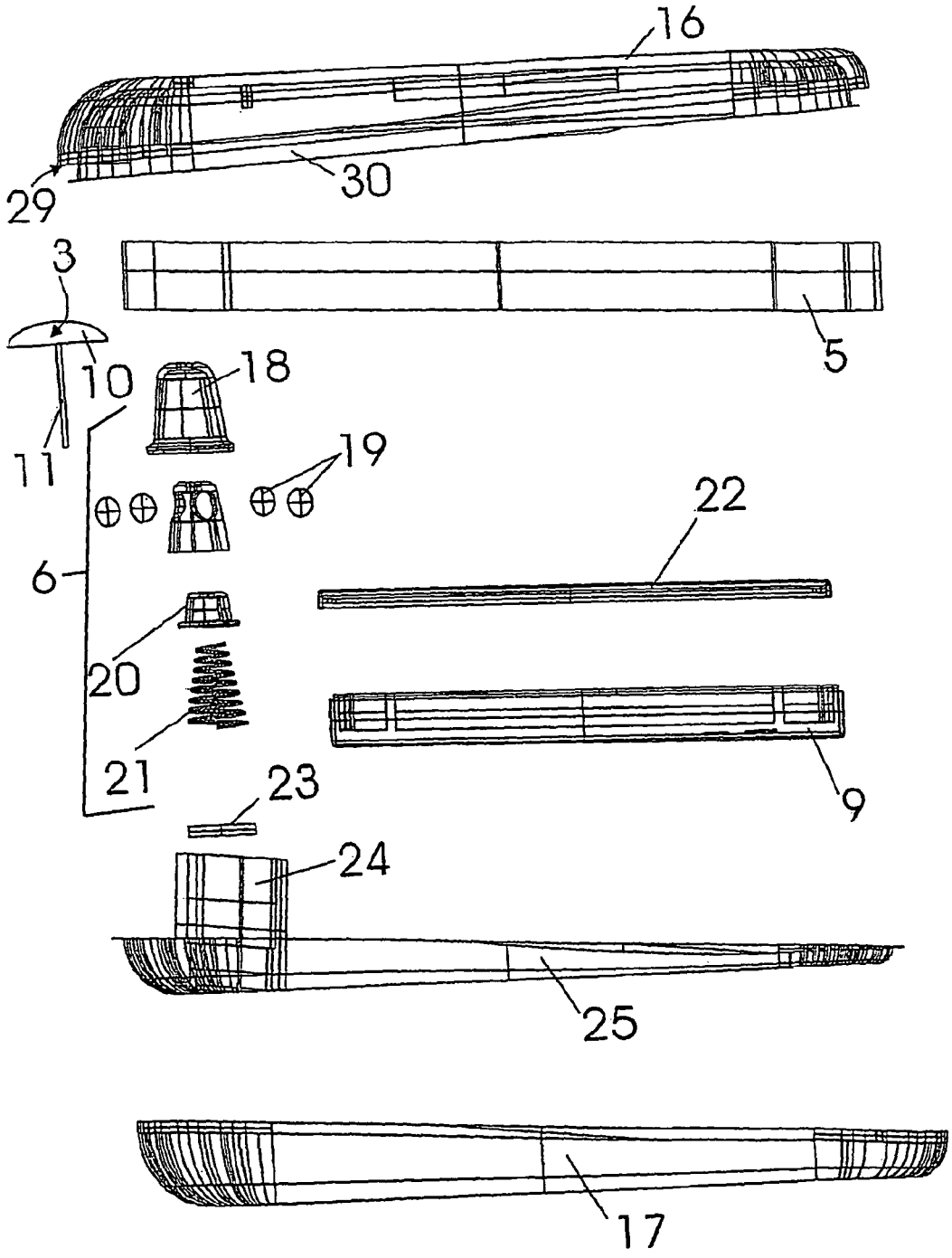

FIG. 1 shows the sectional side view (FIG. 1*a*), the sectional top (FIG. 1*b*), and the spatial side view (FIG. 1*c*) of a very schematic representation of the fundamental structure of the merchandise securing device 1 according to the invention, which can be seen in greater design detail once again in FIG. 3, in an exploded view of the major components of the merchandise securing device 1. In FIG. 4, a top view of the lower half shell 17 of the housing 2 of the merchandise securing device 1 can be seen, in which the components of the AM securing element are shown in greater detail, once again.

The merchandise securing device 1 consists of an essentially wedge-shaped housing 2 composed of two half-shells 16 and 17, between which all the essential components of the inner workings of the merchandise securing device 1 are completely accommodated. In this connection, the housing 2 essentially has an accommodation space 24 for a closure device in the form of a conventional ball closure 6, which is provided with a reinforced helical spring 21 for implementing a strong-lock function. The ball closure consists, in fundamentally known manner, of the helical spring 21, the ball bearing plate 20 for a number of balls 19 that rest against the closure cylinder 18 and wedge themselves against the needle 11 when the needle 11 of the needle-like attachment element 3 is inserted, and thereby hold it in place. Since such ball closures,are comprehensively known, they will not be discussed further here.

Furthermore, at least one merchandise securing element 4, 5, 15 is accommodated in the housing 2, in a corresponding accommodation space, and serves, in fundamentally known manner, for detection of merchandise impermissibly taken through the exit of a store or the like, in that the merchandise securing device 1 interacts with detection devices disposed there. In this connection, it is possible that only one of the merchandise securing elements 4, 5, 15 mentioned above, two, or all of the merchandise securing elements at the same time are present on the merchandise securing device 1. Of course, other merchandise securing elements can also be added, which use other detection technologies. In this connection, the merchandise securing elements 4, 5, 15 are sufficiently known in terms of their fundamental structure, therefore the structure of these merchandise securing elements 4, 5, 15 will only be discussed here to the extent that this is important for their function in the merchandise securing device 1 according to the invention.

The merchandise securing element 5 according to RF technology consists essentially of a coil that is laid along the interior housing walls of the merchandise securing device 1, and, in this connection, is formed in this position by means of corresponding walls of the accommodation space 29 between the inner wall 30 and the upper housing shell 16. This coil 5, which is shown in perspective again in FIG. 5, as a separate component, has multiple coils perpendicular and parallel to one another, which are disposed in a so-called multi-layer coil. This has the advantage that excellent functionality of the merchandise securing device 1 can be achieved, reaching the 8.2 MHz center frequency that is typical for RF technology, and also, a sufficiently large Q factor. These requirements are necessary in order to be able to detect the securing element 5 at corresponding related detection devices, such as RF gates and antennas, with sufficient reliability. The necessary tuning of the center frequency with a possibly related merchandise securing element 4 using AM technology and the closure device 6 that consists of metal must be taken into consideration in this connection. Since detuning in the center frequency can occur by means of these components of the merchandise securing device 1, capacitor, not shown, that is switched in parallel with the coil 5, is used to compensate for the detuning. During interaction with the other components of the merchandise securing device 1, the location of the coil 5 in the lower housing shell 17 of the merchandise securing device 1 is important, since detuning of the resonance frequency also occurs if the coil 5, which typically consists of copper, is bent outside of its basic shape. For this reason, the coil 5 is fixed in place in the accommodation space 29 in the lower housing shell 17, accordingly, by means of the walls 30.

Also in the interior of the housing 2, a merchandise securing element 4 according to AM technology can be seen, in which an amorphous alloy such as METGLAS strip 27 is accommodated in a housing 9 having a lid 22, so as to be capable of vibrating, whereby a magnet 26 is disposed in front of and behind the strip 27, in each instance, in an extension of the strip 27, and forms a detection element by means of AM technology that is capable of vibrating and can be excited from the outside, together with the strip 27. Such a configuration of a merchandise securing element 4 according to AM technology has already been described in detail in DE 10 2006 002 225.4 A1, and therefore reference is made to the disclosure there, to its full extent, at this point.

The accommodation of a merchandise securing element 15 according to RFID technology is only intended to be very roughly indicated; it is shown in FIG. 2, for example, in a further accommodation space in the housing 2. Such merchandise securing elements 15 according to RFID technology are also fundamentally known.

Also in the interior of the housing 2, a monitoring device 28 that is only indicated schematically can be seen; it communicates with alarm devices, not shown, disposed in the surroundings of the merchandise securing device 1, by means of a wireless connection, if the merchandise securing device 1 or parts of the merchandise securing device 1 are exposed to heat or an open flame. Specifically in the case of manipulation attempts on conventional merchandise securing devices 1, parts of the housing 2, which typically consists of plastic, are frequently burned or softened, for example in dressing rooms that are not watched, in the case of conventional ball closures 6, using lighters or battery-operated soldering guns, in such a manner that functionally important parts of the closure device 6 can be removed, in order to subsequently be able to easily remove the merchandise securing device 1 from the merchandise. If a monitoring device 28, using an electronic temperature detection device, for example, now recognizes that temperatures that can be assessed as a manipulation attempt, for example temperatures above 50° C., prevail in the region of the merchandise securing device 1, such a monitoring device 28 can transmit a signal to an alarm device, and thereby draw the attention of sales personnel or security personnel, for example, to the manipulation attempt that is occurring, and, if applicable, also indicate the location of the manipulation attempt. For this purpose, the monitoring device 28 can have an electronic device for wirelessly communicating with the alarm device, by way of which silent or audible alarms can be triggered at the alarm device.

Another measure to prevent such manipulations by means of heat or an open flame, in the form of a protector element 23, can be seen in the figure. For this purpose, the protector element 23, made of a non-metallic, heat-resistant material, is disposed in the region of the closure device 6, in such a manner that in the case of a manipulation in the region of the closure device 6 by means of heat or an open flame, the protector element 23 shields the closure device 6 against the heat of the open flame, in improved manner. Such protector elements 23 were previously known only made of metallic materials, for example small metal plates that were introduced into the housing 2 of a merchandise securing device 1, and guaranteed corresponding shielding of the closure device 6. Such protector elements 23 made of metallic materials are greatly disadvantageous in the case of the merchandise securing device 1 present here, however, since they, just like the closure device 6, impair the functioning of the merchandise securing elements 4, 5, 15, and, in particular, the resonance frequency of an 8.2 MHz RF coil 5, and can actually make it impossible. For this reason, non-metallic heat-resistant materials such as mica, silicone, or the like should be introduced, for example, into an accommodation chamber, lying opposite the needle-like attachment means 3, below the closure element 6, so that they can form a heat shield and so that it is or becomes more difficult to melt the ball closure 6 out of the housing 2 of the merchandise securing device 1 during manipulation attempts.

Also only indicated only schematically in the figures is a pass-through opening 31 that extends through the housing 2, by means of which suitable flexible hanging devices, not shown, particularly wire cables or the like, can be passed through with one end, and fixed in place, and which can be fixed in place on the merchandise securing device 1 by means of the closure device 6 at their other end. In this way, the merchandise securing device 1 according to the invention can be modified for being affixed to so-called handle merchandise such as suitcases or the like, on which the merchandise securing device 1 cannot be fixed in place using a needle-like attachment element 3. Thin steel cables used for this purpose can be fixed in place with a thickened end, for example, which does not fit through the pass-through opening in the housing 2, on the housing 2 of the merchandise securing device 1, and fixed in place on the closure device 6 with their other end, and thereby loop around a section of the merchandise to be secured, in loose but unreleasable manner.

The housing shells 16, 17 are set onto one another after the corresponding functional elements have been placed therein, and welded to one another in fluid-tight manner, so that in particular, the sections of the merchandise securing device 1 that are and must be accessible from the outside (the region of the closure device 6 and the pass-through opening 31) are separated from the regions of the housing that are not allowed to come into contact with water or the like, in fluid-tight manner.

By means of the configuration of the outer shape of the housing 2 of the merchandise securing device 1, the merchandise lies essentially flat against the merchandise securing device 1, at least in the region of the fixation, i.e. the possible contact zone, 7 to the merchandise securing device 1, and is therefore no longer stressed around the ball closure device 6 or the like, which is otherwise usually configured to project from the device 1. In this connection, the closure device 6 itself can also be configured, with regard to its outer contours, in such a manner that it is configured to be planar in the region of the possible contact zone 7 with the merchandise. Also, the housing 2 of the merchandise securing device 1 covers the closure device 6 essentially over its full area in the region of the possible contact zone 7 with the merchandise, in level manner, and only has one access, for example a small, access 8 that can be a hole, for insertion of the needle-like attachment element 3.

In addition, manipulation protection of the merchandise securing device 1 is increased by means of such an extensive coverage of the closure device 6 by the housing 2 of the merchandise securing device 1, since the closure device 6 itself is no longer directly open as it functions, and also, the necessary method for releasing the closure device 6 is not easy for a thief to recognize. By placing at least one merchandise securing element 4, 5, 15 that works either with acousto-magnetic technology (AM technology) or radio frequency technology (RF technology) or radio frequency identification technology (RFID technology), or even a plurality of such merchandise securing elements 4, 5, 15 using different technologies, on or in the merchandise securing device 1 at the same time, it is possible to configure a merchandise securing device 1 that can be universally used even for different detection technologies used by the merchants, in each instance, and which is equally well suited for and compatible with almost all types of merchandise, regardless of whether merchandise is robust, i.e. sturdy, or is a light textile.

FIG. 2 shows a modification of the housing 2, in that the housing 2 of the merchandise securing device 1 has an accommodation 12, particularly a window-like one, for flat data carriers 13 such as price tags or the like. If such a flat data carrier 13 is inserted into the window-like accommodation 12 disposed, for example, on one of the outer surfaces of the housing 2, for example an accommodation that is closed off on all sides, with the exception of one edge 32, and provided with a flat, open or transparent region surrounded by the edges 32, then the customer can read information concerning the price and possible discounts, for example, concerning merchandise properties, or other information, directly on the merchandise securing device 1, in clearly legible form, comprehensible to the customer. For the commercial user of such merchandise securing devices 1, the window-like accommodation 12 offers the possibility of affixing easily replaceable data carriers 13 concerning manufacturing data, barcodes, product identification data, or the like, directly to the merchandise securing device 1, and thereby using the merchandise securing device 1 as a carrier medium for improving merchandise logistics, for example, even in advance of selling the merchandise. Such a data carrier 13 can also be easily removed from the window-like accommodation 12, and handed over to the customer during a payment procedure, for example, for payment at the cash register, or also for returns. Also, the data carriers 13 within the window-like accommodation 12 can easily be replaced and supplemented, or also covered up, something that becomes necessary in the case of a price change, for example.

It is also possible, for example, to dispose merchandise securing elements 4, 5 using AM or RF technology, additionally or alternatively, on a merchandise securing device 1 that accommodates a merchandise securing element 15 using RFID technology within its housing 2, in such a manner that these merchandise securing elements 4, 5 using AM or RF technology, laminated in, for example, between planar layers of paperboard or plastics, as a thin card, are pushed into the window-like accommodation 12, and therefore make corresponding merchandise securing technologies available, temporarily or in addition. In this connection, the window-like accommodation 12 serves as an additional accommodation space. It is advantageous, in this connection, that these merchandise securing elements 4, 5 using AM or RF technology can be hidden in very unnoticeable manner, for example behind a paperboard label containing price information, and that in this way, a further increase in the manipulation security of the merchandise securing device 1 can be achieved, without great additional costs.

Another particular property of the merchandise securing device 1 can be achieved in that the data carriers 13 laid into the window-like accommodation 12, or also the additional merchandise securing elements 4, 5 using AM or RF technology, can be secured within the window-like accommodation 12 in that the needle-like attachment element 3 is inserted into the closure device 6 within the housing 2, in such a manner that unauthorized removal of the data carriers 13 or also of the additional merchandise securing elements 4, 5 is blocked by means of the needle-like attachment element 3. For this purpose, as shown in FIG. 2*b*, the needle-like attachment element 3 can be disposed on the single open insertion side or fixation region 14 of the window-like accommodation 12, for example, in the insertion direction of the data carriers 13, in such a manner that the needle-like attachment element 3 blocks this open insertion side or fixation region 14 of the window-like accommodation 12 after insertion, and the data carrier 13 can no longer be pulled out, for example.

The invention claimed is:

1. A merchandise anti-theft device comprising:

an outer housing, a fixation region of the outer housing being essentially planar;

a closure device having a recess and a clamping element;

a needle-like attachment element insertable into the clamping element of the closure device;

a first anti-theft element having radio-frequency technology; and a second anti-theft element having acousto-magnetic technology, the second anti-theft element being arranged to be enclosed by the first anti-theft element.

2. The merchandise anti-theft device according to claim 1, wherein at least one of the first and second anti-theft elements is configured so that the at least one of the first and second anti-theft elements cannot be deactivated.

3. The merchandise anti-theft device according to claim 1, further comprising a third anti-theft element, the third anti-theft element having RFID technology, being disposed on or in the outer housing of the merchandise anti-theft device, and being able to accommodate information concerning merchandise.

4. The merchandise anti-theft device according to claim 1, wherein the first anti-theft element has a coil arrangement in a multi-layer coil, a first portion of the coil arrangement being disposed perpendicular to a second portion of the coil arrangement, and a third portion of the coil arrangement being arranged parallel to the first portion of the coil arrangement.

5. The merchandise anti-theft device according to claim 4, the first anti-theft element also having a parallel capacitor;

wherein the coil arrangement has an electrically conductive connection with the parallel capacitor, the parallel capacitor compensating for unavoidable influences on a frequency of the first anti-theft element, the unavoidable influences being caused by metallic components of the merchandise anti-theft device.

6. The merchandise anti-theft device according to claim 1, wherein the closure device comprises a conventional ball closure.

7. The merchandise anti-theft device according to claim 6, wherein the closure device is configured as a disposable closure device.

8. The merchandise anti-theft device according to claim 1, wherein the closure device is configured with a strong-lock function.

9. The merchandise anti-theft device according to claim 8, wherein release of the closure device having a strong-lock function is only possible with magnetic openers having a magnetic field intensity of more than 9000 Gauss.

10. The merchandise anti-theft device according to claim 1, further comprising an accommodation for flat data carriers.

11. The merchandise anti-theft device according to claim 10, wherein the accommodation is disposed on an outer surface of the outer housing.

12. The merchandise anti-theft device according to claim 10, wherein the accommodation has an edging closed off on all sides except one and has a flat, open or transparent center region surrounded by the edging.

13. The merchandise anti-theft device according to claim 10, wherein in the accommodation, clearly legible information can be read and comprehended by the customer.

14. The merchandise anti-theft device according to claim 10, wherein in the accommodation, in an easily replaceable manner, at least one data carrier can be affixed.

15. The merchandise anti-theft device according to claim 14, wherein the at least one data carrier can be easily removed from the accommodation and handed over to a customer.

16. The merchandise anti-theft device according to claim 14, wherein the at least one data carrier or the first and second anti-theft elements can be secured within the accommodation in that the needle-like attachment element is inserted into the closure device within the outer housing, relative to the accommodation, in such a manner that unauthorized removal of the at least one data carrier or of the first and second anti-theft elements is blocked via the needle-like attachment element.

17. The merchandise anti-theft device according to claim 16, wherein the at least one data carrier can be secured within the accommodation in that the needle-like attachment element is inserted into the closure device within the outer housing, relative to the accommodation, in such a manner that unauthorized removal of the at least one data carrier is blocked via the needle-like attachment element; and wherein the needle-like attachment element passes through a section of the at least one data carrier when the needle-like attachment element is inserted into the closure device within the outer housing, and thereby secures the at least one data carrier to prevent the at least one data carrier from being removed from the accommodation.

18. The merchandise anti-theft device according to claim 10, the merchandise anti-theft device further comprising a third anti-theft element, the third anti-theft element having RFID technology and being within the outer housing;

wherein the first and second anti-theft elements can be pushed into the accommodation.

19. The merchandise anti-theft device according to claim 18, wherein the first and second anti-theft elements are disposed in a very unnoticeable manner behind a label containing price information, the label being in the accommodation.

20. The merchandise anti-theft device according to claim 10, wherein the accommodation can be releasably affixed to the outer housing and separated from the outer housing.

21. The merchandise anti-theft device according to claim 20, wherein the accommodation can be handed over to a customer after the accommodation is separated from the outer housing.

22. The merchandise anti-theft device according to claim 10, further comprising a monitoring device disposed in the outer housing, the monitoring device being able to wirelessly communicate with an alarm devices disposed in surroundings of the merchandise anti-theft device if the merchandise anti-theft device is exposed to heat or an open flame.

23. The merchandise anti-theft device according to claim 22, wherein the monitoring device has an electronic temperature detection device, the electronic temperature detection device being able to detect heat or an open flame when the merchandise anti-theft device is exposed to the heat or the open flame.

24. The merchandise anti-theft device according to claim 23, wherein if the electronic temperature detection device detects that a limit temperature has been exceeded on the merchandise anti-theft device the electronic temperature detection device transmits a signal to the alarm device.

25. The merchandise anti-theft device according to claim 22, wherein by way of the monitoring device silent or audible alarms can be triggered at the alarm device.

26. The merchandise anti-theft device according to claim 1, further comprising a protector element made of a non-metallic, heat-resistant material disposed in a region of the closure device, wherein the protector element shields the closure device from heat or open flame if a manipulation attempt is made via the heat or the open flame to damage the closure device and thereby remove the merchandise anti-theft device from merchandise.

27. The merchandise anti-theft device according to claim 26, wherein the protector element is a disk or a shell and is disposed below the closure device, lying opposite the needle-like attachment element.

28. The merchandise anti-theft device according to claim 26, wherein the protector element is disposed on or in the outer housing of the merchandise anti-theft device.

29. The merchandise anti-theft device according to claim 1, wherein a dye ring is disposed on the needle-like attachment element and completely surrounds the needle-like attachment element in a region of a head of the needle-like attachment element.

30. The merchandise anti-theft device according to claim 1, wherein the outer housing is configured in a mechanically stable manner.

31. The merchandise anti-theft device according to claim 1, wherein the outer housing is formed from a plastic material.

32. The merchandise anti-theft device according to claim 1, wherein the outer housing has a surface structure that is not smooth.

33. The merchandise anti-theft device according to claim 1, wherein a date clock indicating the point in time of production of the merchandise anti-theft device is visibly applied to the outer housing.

34. The merchandise anti-theft device according to claim 1, wherein the outer housing is sealed to prevent penetration of moisture.

35. The merchandise anti-theft device according to claim 34, wherein a first region of the closure device and a second region of the first and second anti-theft elements are configured separate from one another, and sealed relative to one another in a fluid-tight manner.

36. The merchandise anti-theft device according to claim 1, wherein the outer housing has a continuous pass-through opening.

37. The merchandise anti-theft device according to claim 1, wherein the merchandise anti-theft device has a weight of less than 15 g.

38. The merchandise anti-theft device according to claim 1, wherein a needle of the needle-like attachment element is produced from a non-rusting material.

39. The merchandise anti-theft device according to claim 1, wherein a head of the needle-like attachment element completely sheathes a needle of the needle-like attachment element in an end region of the needle, the end region facing away from the closure device when the needle-like attachment element is inserted into the closure device, and wherein the head accommodates the needle within the head.

40. The merchandise anti-theft device according to claim 1, wherein an underside of a head of the needle-like attachment element is configured to be smooth and faces the closure device when the needle-like attachment element is inserted into the closure device.

41. The merchandise anti-theft device according to claim 1, wherein the needle-like attachment element can be inserted into the outer housing of the merchandise anti-theft device in such a manner that a needle-like end of the needle-like attachment element does not come to rest where the needle-like end is freely accessible from outside the outer housing.

* * * * *